US009105188B2

(12) United States Patent
Alshinnawi et al.

(10) Patent No.: US 9,105,188 B2
(45) **Date of Patent: *Aug. 11, 2015**

(54) CONTROLLING VEHICULAR TRAFFIC ON A ONE-WAY ROADWAY

(71) Applicant: Lenovo Enterprise Solutions (Singapore) Pte. Ltd., Singapore (SG)

(72) Inventors: Shareef F. Alshinnawi, Durham, NC (US); Gary D. Cudak, Creedmoor, NC (US); Edward S. Suffern, Chapel Hill, NC (US); J. Mark Weber, Wake Forest, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 81 days.

This patent is subject to a terminal disclaimer.

(21) Appl. No.: 14/032,331

(22) Filed: Sep. 20, 2013

(65) Prior Publication Data

US 2015/0077271 A1 Mar. 19, 2015

Related U.S. Application Data

(63) Continuation of application No. 14/030,447, filed on Sep. 18, 2013, now Pat. No. 9,024,787.

(51) Int. Cl.

| | |
|---|---|
| ***G08G 1/00*** | (2006.01) |
| ***G08G 1/065*** | (2006.01) |
| ***G08G 1/0967*** | (2006.01) |
| ***G08B 5/36*** | (2006.01) |
| ***G08G 1/01*** | (2006.01) |
| ***G08G 1/056*** | (2006.01) |

(52) U.S. Cl.
CPC ..... *G08G 1/096783* (2013.01); *G08B 5/36* (2013.01); *G08G 1/0145* (2013.01); *G08G 1/056* (2013.01)

(58) Field of Classification Search
CPC ..... G08G 1/056; E01F 13/105
USPC ..... 340/928, 905, 935; 701/117
See application file for complete search history.

(56) References Cited

U.S. PATENT DOCUMENTS

| | | | |
|---|---|---|---|
| 3,753,223 | A | 8/1973 | Fayling |
| 3,805,448 | A | 4/1974 | Carr et al. |
| 3,876,973 | A | 4/1975 | Griebel |

(Continued)

FOREIGN PATENT DOCUMENTS

| | | | |
|---|---|---|---|
| EP | 1671866 | A1 | 6/2006 |
| EP | 2234083 | B1 | 1/2012 |

(Continued)

*Primary Examiner* — John A Tweel, Jr.
(74) *Attorney, Agent, or Firm* — Law Office of Jim Boice

(57) ABSTRACT

A method controls vehicular traffic on a one-way roadway. A hardware sensor detects vehicular traffic on a roadway. A hardware traffic control device determines whether the vehicular traffic on the roadway has been moving exclusively in a first direction during a preceding period of time, such that the roadway is a one-way roadway on which current vehicular traffic is authorized to travel only in the first direction. The hardware sensor detects an errant vehicle that is traveling on the one-way roadway in a second direction that is opposite the first direction. In response to determining that the errant vehicle is traveling in the second direction on the one-way roadway, a warning signal is transmitted to vehicles, other than the errant vehicle, on the one-way roadway.

15 Claims, 4 Drawing Sheets

(56) References Cited

U.S. PATENT DOCUMENTS

| | | | | |
|---|---|---|---|---|
| 5,203,422 | A | 4/1993 | Estep et al. | |
| 6,084,533 | A * | 7/2000 | Morgan et al. | 340/935 |
| 6,223,125 | B1 | 4/2001 | Hall | |
| 7,649,444 | B1 | 1/2010 | Fear et al. | |
| 8,265,987 | B2 | 9/2012 | Goto | |
| 8,423,250 | B2 * | 4/2013 | Kondou et al. | 701/53 |
| 8,428,861 | B1 * | 4/2013 | Williams et al. | 701/301 |
| 8,754,782 | B2 * | 6/2014 | Tagawa et al. | 340/905 |
| 8,838,370 | B2 * | 9/2014 | Wolfe | 701/117 |
| 2003/0001742 | A1 | 1/2003 | Eshelman et al. | |
| 2008/0021643 | A1 | 1/2008 | Nishiyama | |
| 2011/0081201 | A1 | 4/2011 | Croce | |
| 2011/0221585 | A1 | 9/2011 | Higuchi et al. | |
| 2012/0271540 | A1 | 10/2012 | Miksa et al. | |
| 2012/0290150 | A1 | 11/2012 | Doughty et al. | |
| 2013/0044009 | A1 | 2/2013 | Tagawa et al. | |

FOREIGN PATENT DOCUMENTS

| | | | |
|---|---|---|---|
| JP | 2007140757 | A | 6/2007 |
| WO | 9313385 | | 7/1993 |
| WO | 0046775 | | 8/2000 |
| WO | 03081514 | A1 | 10/2003 |
| WO | 03086833 | A1 | 10/2003 |

* cited by examiner

CONTROLLING VEHICULAR TRAFFIC ON A ONE-WAY ROADWAY

BACKGROUND

The present disclosure relates to traffic control devices, and specifically to traffic control devices within the context of one-way roadways. Still more particularly, the present disclosure relates to controlling an errant vehicle that poses a threat of traveling the wrong direction on a one-way roadway.

Roadways include any surface on which motor vehicles (e.g., cars, trucks, buses, etc.) are driven. Examples of roadways include, but are not limited to, city and residential streets, city avenues, rural roads, highways, parking lots, etc. Some roadways allow for bi-directional vehicular traffic, either on a shared lane or on dedicated lanes (e.g., a first lane for traveling in one direction and a second lane for traveling in the opposite direction). Certain roadways allow traffic to move in only one direction, and thus are known as "one-way" roadways.

SUMMARY

In one embodiment of the present invention, a hardware traffic control device, which is physically positioned adjacent to a roadway, controls vehicular traffic on a one-way roadway. A hardware sensor detects vehicular traffic on a roadway in order to enable a hardware traffic control device to determine that the vehicular traffic on the roadway has been moving exclusively in a first direction during a preceding period of time, thus identifying the roadway as a one-way roadway in which current vehicular traffic is authorized to travel only in the first direction. The hardware sensor then detects an errant vehicle that is traveling in the opposite direction on the one-way roadway. A disabling signal transmitter then transmits a disabling electronic signal to disable a distracting electronic device within the errant vehicle, wherein the distracting electronic device has been predetermined to reduce a driver's attention to driving a motor vehicle.

In one embodiment of the present invention, a computer program product controls vehicular traffic on a one-way roadway. The computer program product comprises a computer readable storage medium having program code embodied therewith, the program code readable and executable by one or more processors to perform a method comprising: receiving a detection, by a hardware sensor, of vehicular traffic on a roadway; determining, based on the detection of vehicular traffic from the hardware sensor, that the vehicular traffic on the roadway has been moving exclusively in a first direction during a preceding period of time; in response to determining that the vehicular traffic has been moving exclusively in the first direction during the preceding period of time, identifying the roadway as a one-way roadway in which current vehicular traffic is authorized to travel only in the first direction; receiving, from the hardware sensor, a signal identifying an errant vehicle that is traveling in a second direction on the one-way roadway, wherein the second direction is opposite the first direction; and in response to determining that the errant vehicle is traveling in the second direction on the one-way roadway, automatically transmitting an electronic steering signal, to a hardware vehicle controller within the errant vehicle, to steer the errant vehicle to a side of the one-way roadway.

In one embodiment of the present invention, a method of controlling vehicular traffic on a one-way roadway comprises: detecting, by a hardware sensor, vehicular traffic on a roadway; determining, by a hardware traffic control device, whether the vehicular traffic on the roadway has been moving exclusively in a first direction during a preceding period of time; in response to determining that the vehicular traffic has been moving exclusively in the first direction during the preceding period of time, identifying, by the hardware traffic control device, the roadway as a one-way roadway in which current vehicular traffic is authorized to travel only in the first direction; detecting, by the hardware sensor, an errant vehicle that is traveling in a second direction on the one-way roadway, wherein the second direction is opposite the first direction; and in response to determining that the errant vehicle is traveling in the second direction on the one-way roadway, transmitting a warning signal to other vehicles on the one-way roadway, wherein the other vehicles exclude the errant vehicle.

DETAILED DESCRIPTION

Figure 1:
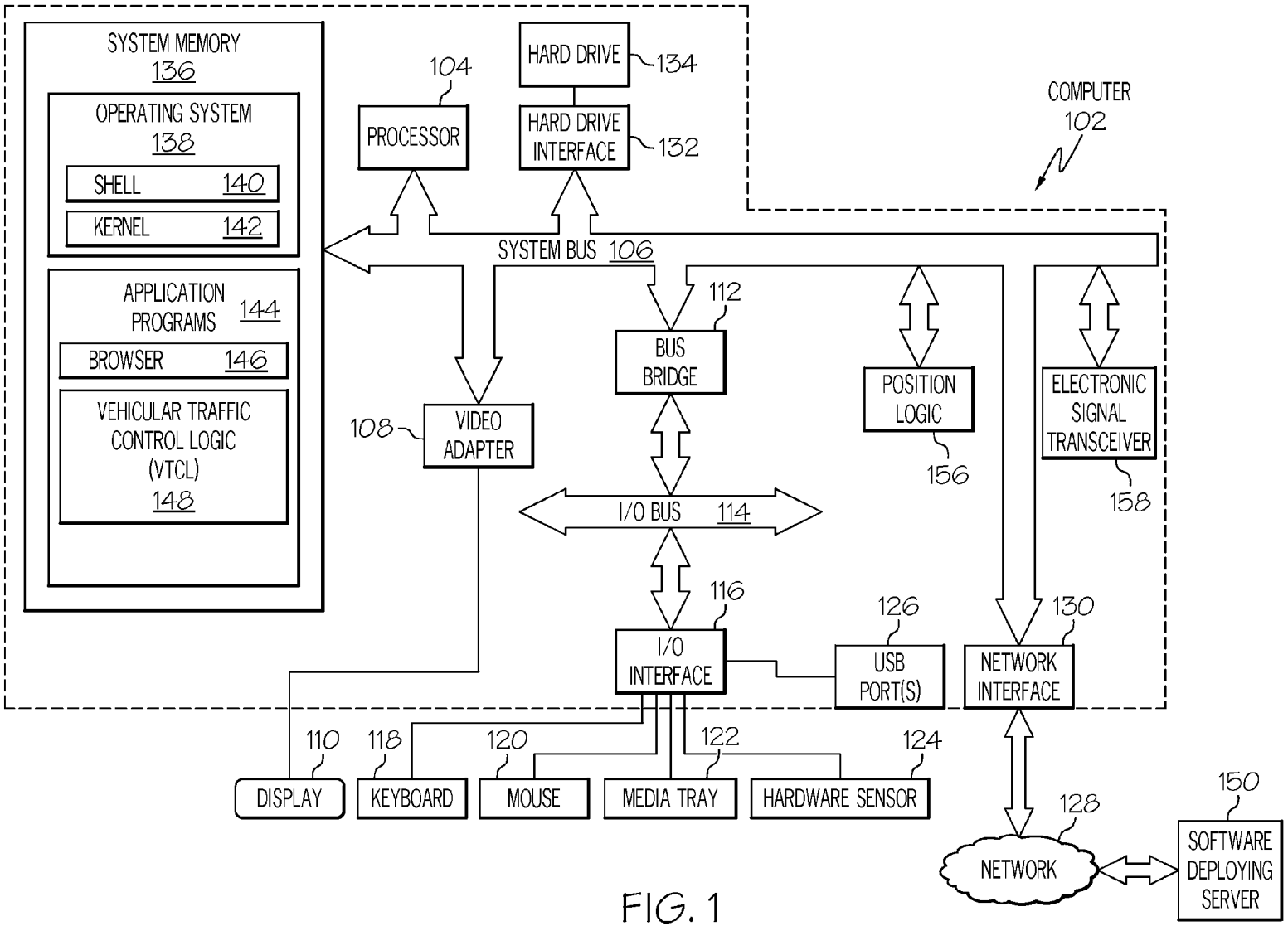
FIG. 1 depicts an exemplary system and network which may be used to implement the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

With reference now to the figures, and in particular to FIG. 1, there is depicted a block diagram of an exemplary system and/or network that may be utilized by and/or in the implementation of the present invention. Note that some or all of the exemplary architecture, including both depicted hardware and software, shown for and within computer 102 may be utilized by software deploying server 150, and/or one or more devices depicted in FIG. 2 and/or FIG. 3, including, but not limited to hardware traffic control device 208, warning sign 214, hardware vehicle controller 302, distracting device 318, and/or other systems depicted herein.

Exemplary computer 102 includes a processor 104 that is coupled to a system bus 106. Processor 104 may utilize one or more processors, each of which has one or more processor cores. A video adapter 108, which drives/supports a display 110, is also coupled to system bus 106. System bus 106 is coupled via a bus bridge 112 to an input/output (I/O) bus 114. An I/O interface 116 is coupled to I/O bus 114. I/O interface 116 affords communication with various I/O devices, including a keyboard 118, a mouse 120, a media tray 122 (which may include storage devices such as CD-ROM drives, multimedia interfaces, etc.), a hardware sensor 124, and external USB port(s) 126. While the format of the ports connected to I/O interface 116 may be any known to those skilled in the art of computer architecture, in one embodiment some or all of these ports are universal serial bus (USB) ports.

As depicted, computer 102 is able to communicate with a software deploying server 150 and/or other devices (not depicted) using a network interface 130. Network interface 130 is a hardware network interface, such as a network interface card (NIC), etc. Network 128 may be an external network such as the Internet, or an internal network such as an Ethernet or a virtual private network (VPN).

Furthermore, in an embodiment in which the computers/devices are mobile and/or wireless devices, network 128 is a wireless network. Examples of such a wireless network include, but are not limited to, a near field communication (NFC) network (in which devices communicate at ranges of 4 cm or less); personal area networks (PANs), such as those that use industrial, scientific, and medical (ISM) radio bands and protocols defined in the Institute of Electrical and Electronics Engineers (IEEE) 802.15.1 standard for wireless communications within a few meters; and/or a Wi-Fi network, which enables wireless communication in a range of approximately 100 meters in accordance with the IEEE 802.11x standards.

A hard drive interface 132 is also coupled to system bus 106. Hard drive interface 132 interfaces with a hard drive 134. In one embodiment, hard drive 134 populates a system memory 136, which is also coupled to system bus 106. System memory is defined as a lowest level of volatile memory in computer 102. This volatile memory includes additional higher levels of volatile memory (not shown), including, but not limited to, cache memory, registers and buffers. Data that populates system memory 136 includes computer 102's operating system (OS) 138 and application programs 144.

OS 138 includes a shell 140, for providing transparent user access to resources such as application programs 144. Generally, shell 140 is a program that provides an interpreter and an interface between the user and the operating system. More specifically, shell 140 executes commands that are entered into a command line user interface or from a file. Thus, shell 140, also called a command processor, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 142) for processing. Note that while shell 140 is a text-based, line-oriented user interface, the present invention will equally well support other user interface modes, such as graphical, voice, gestural, etc.

As depicted, OS 138 also includes kernel 142, which includes lower levels of functionality for OS 138, including providing essential services required by other parts of OS 138 and application programs 144, including memory management, process and task management, disk management, and mouse and keyboard management.

Application programs 144 include a renderer, shown in exemplary manner as a browser 146. Browser 146 includes program modules and instructions enabling a world wide web (WWW) client (i.e., computer 102) to send and receive network messages to the Internet using hypertext transfer protocol (HTTP) messaging, thus enabling communication with software deploying server 150 and other computer systems.

Application programs 144 in computer 102's system memory (as well as software deploying server 150's system memory) also include a vehicular traffic control logic (VTCL) 148. VTCL 148 includes code for implementing the processes described below, including those described and/or referenced in FIGS. 2-4. In one embodiment, computer 102 is able to download VTCL 148 from software deploying server 150, including in an on-demand basis, wherein the code in VTCL 148 is not downloaded until needed for execution. Note further that, in one embodiment of the present invention, software deploying server 150 performs all of the functions associated with the present invention (including execution of VTCL 148), thus freeing computer 102 from having to use its own internal computing resources to execute VTCL 148.

Also within computer 102 is a position logic 156. Position logic 156 is hardware logic that is able to determine the physical location of computer 102 in real time. For example, position logic 156 may be a global positioning system (GPS) receiver, a local triangulation system (e.g., that receives wireless signals from local transmitters, and triangulates these signals to establish a fine-grained location of a device), or any other positioning systems (including those disclosed in further detail herein) for determining a current location of a device.

Note that the hardware elements depicted in computer 102 are not intended to be exhaustive, but rather are representative to highlight essential components required by the present invention. For instance, computer 102 may include alternate memory storage devices such as magnetic cassettes, digital versatile disks (DVDs), Bernoulli cartridges, and the like. These and other variations are intended to be within the spirit and scope of the present invention.

Figure 2:
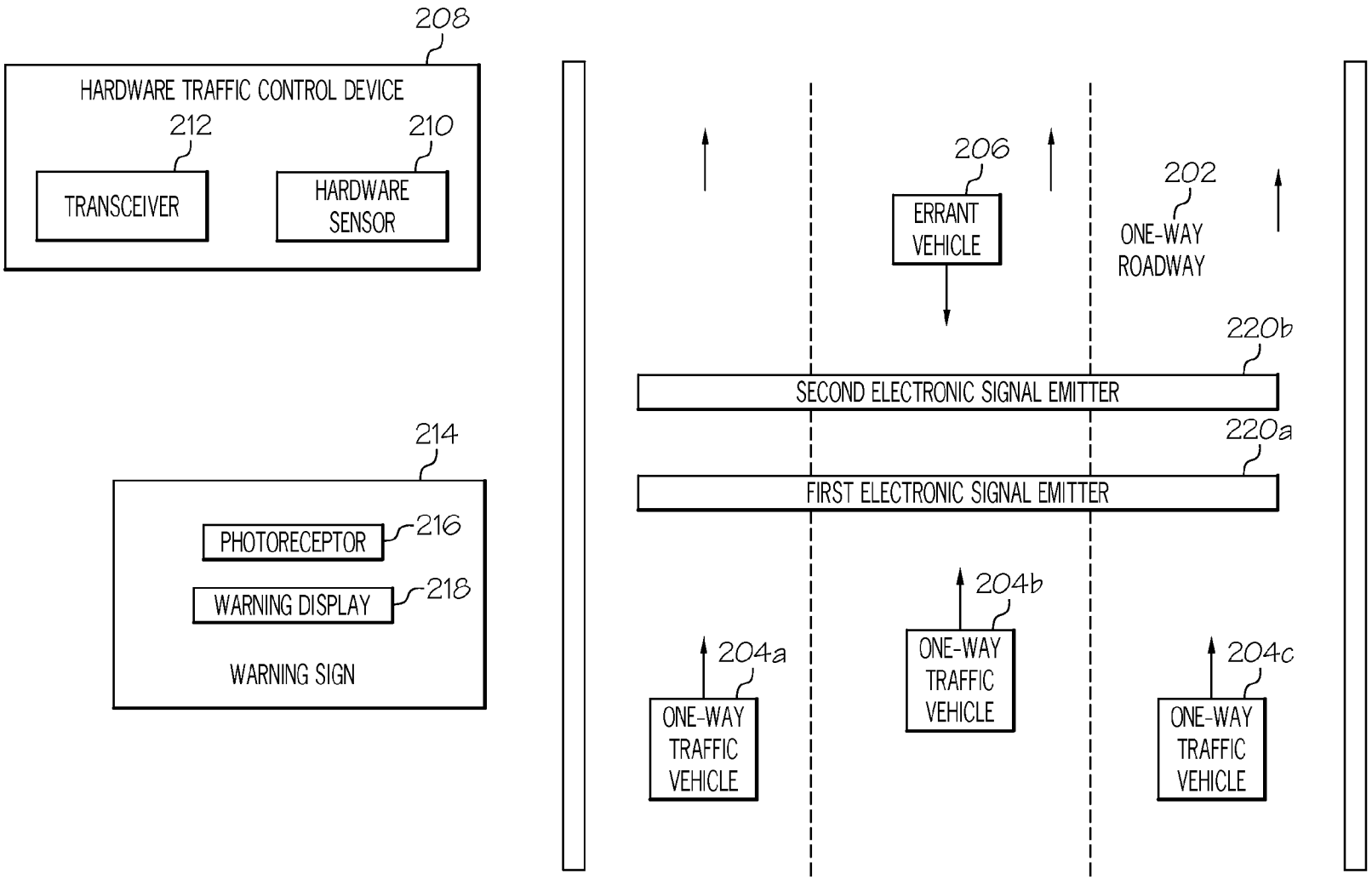
FIG. 2 depicts an exemplary one-way roadway on which the present invention may be implemented.

With reference now to FIG. 2, an exemplary one-way roadway 202 on which the present invention may be implemented is presented. One-way roadway 202 may be an urban street, a rural road, an interstate highway, a freeway, a parking lot, and/or any other constructed surface that is designed to handle vehicular traffic, including but not limited to cars, trucks, buses, motorcycles, etc. One-way roadway 202 is a roadway that is designated as "one-way", in which all vehicular traffic is to travel in the same direction. As depicted, most of the vehicular traffic, depicted as one-way traffic vehicles 204*a*-204*c* (where "c" is an integer), is traveling in the correct first direction (i.e., in the correct direction for traffic flow on the one-way roadway 202). However, at least one errant vehicle 206 is traveling the "wrong way" (i.e., in the opposite direction as the correct direction for traffic on the one-way roadway 202). As used herein, "errant" is defined as "straying from a proper course". Thus, an "errant vehicle" is a motor vehicle that is traveling in an improper direction (e.g., the wrong way on a one-way roadway/street); an "errant driver" is driving a motor vehicle in an improper direction; etc.

As described herein, various embodiments utilize different hardware devices to detect/identify and respond to errant vehicle 206, including but not limited to, a hardware traffic control device 208 (which in one embodiment comprises a depicted hardware sensor 210 and/or transceiver 212), a warning sign 214 (which in one embodiment comprises a photoreceptor 216 and/or a warning display 218), and/or a pair of electronic signal emitters (depicted as a first electronic signal emitter 220*a* and a second electronic signal emitter 220*b*) that are embedded in or placed atop the one-way roadway 202.

Figure 3:
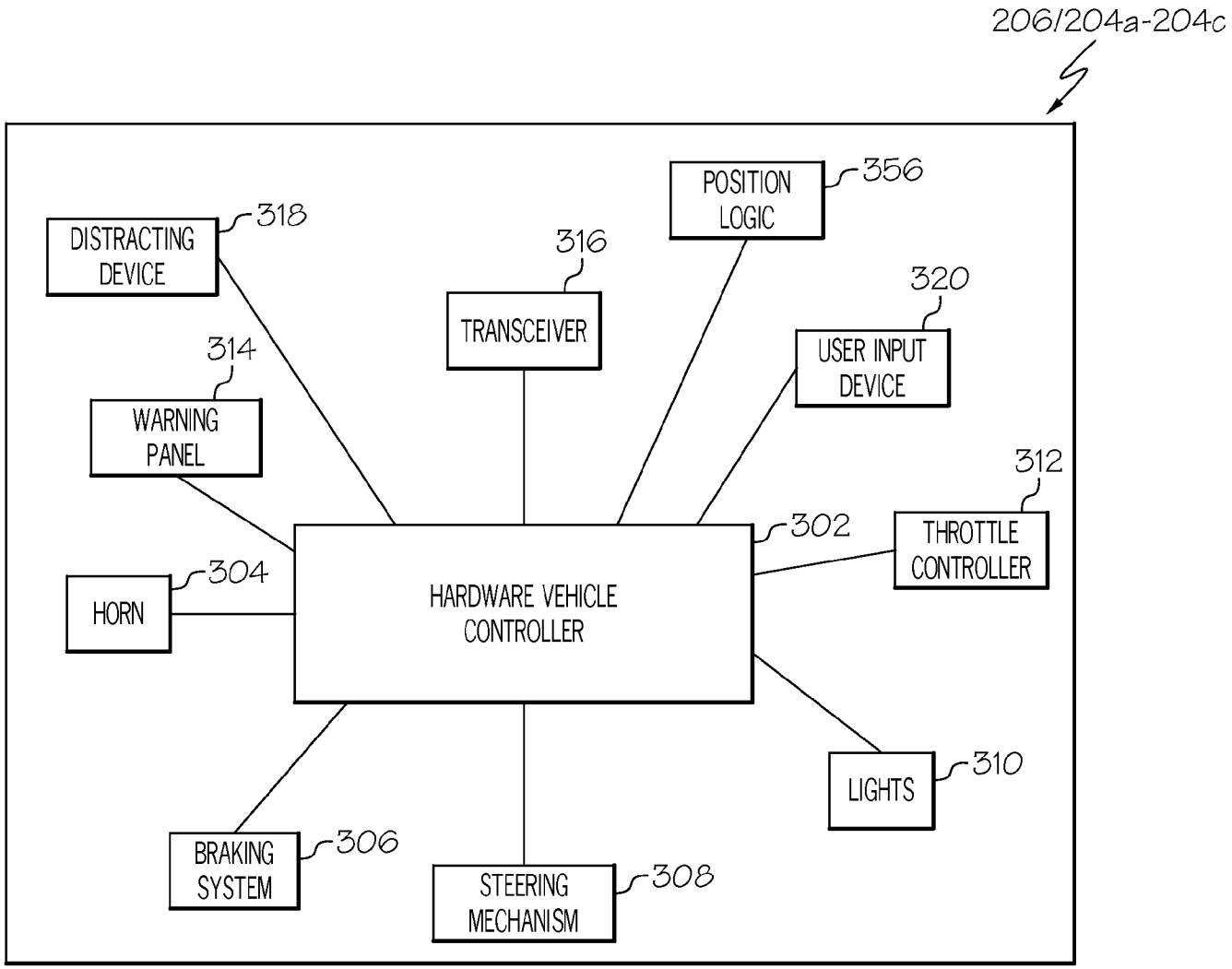
FIG. 3 illustrates exemplary hardware within an errant vehicle used by one or more embodiments of the present invention.

With reference now to FIG. 3, exemplary hardware devices and/or systems within the errant vehicle 206 and/or the one-way traffic vehicles 204*a*-204*c* (depicted in FIG. 2) used by one or more embodiments of the present invention are presented. In one embodiment, a hardware vehicle controller 302 (e.g., a computer logic using some or all of the architecture depicted in FIG. 1 for computer 102) is coupled to various hardware devices on the errant vehicle 206, including but not limited to, a horn 304 (i.e., a system of actuators, airlines, electronic devices used to actuate an included auditory annunciator); a braking system 306 (i.e., a system of hoses, cylinders, brake calipers/pads, rotors, etc. used to slow/stop a motor vehicle), a steering mechanism 308 (i.e., a system of mechanical assistance devices and linkages to the front wheels and/or rear wheels (in the case of all-wheel-steering) to control the direction of a motor vehicle); lights 310 (i.e., headlights, fog lights, flasher warning lights, etc. that are visible on the exterior of a motor vehicle); a throttle controller 312 (i.e., mechanical and electrical controls that controls the amount of air/fuel that are burned by a vehicle's engine and/or which gear in the vehicle's transmission is engaged, thus controlling the overall speed of the vehicle); and/or a warning panel 314 (e.g., warning lights and/or audible signals displayed on/from the vehicle's dashboard).

Also coupled to the hardware vehicle controller 302 is a transceiver 316, which is able to communicate via wireless signals to the hardware traffic control device 208 and/or the first and second electronic signal emitters 220*a*-*b* depicted in FIG. 2. Furthermore, transceiver 316 allows the errant vehicle 206 and the one-way traffic vehicles 204*a*-204*c* depicted in FIG. 2 to communicate among one another.

Also coupled to the hardware vehicle controller 302 are one or more distracting devices, such as distracting device 318. Distracting device 318 is any device that has been predetermined to distract a vehicle's driver away from his/her driving duties. Examples of such predetermined devices include, but are not limited to, "smart" cell phones (in text, voice, and/or browsing mode), radios (both radio receivers used to receive broadcast programming as well as two-way radios), MP3 players, handheld video games, tablet computers, etc.

As further depicted in FIG. 3, a position logic 356 (similar to the position logic 156 depicted in FIG. 1) is coupled to (or is part of) the hardware vehicle controller 302. The position logic 356 may be a Global Positioning System (GPS) map-based system; a sensor-based system (e.g., a system that determines a vehicle's position and/or direction of travel by interrogating RFID chips in, on, or beside a roadway); and/or any other system used to identify the location and/or direction of travel of a particular motor vehicle.

Figure 4:
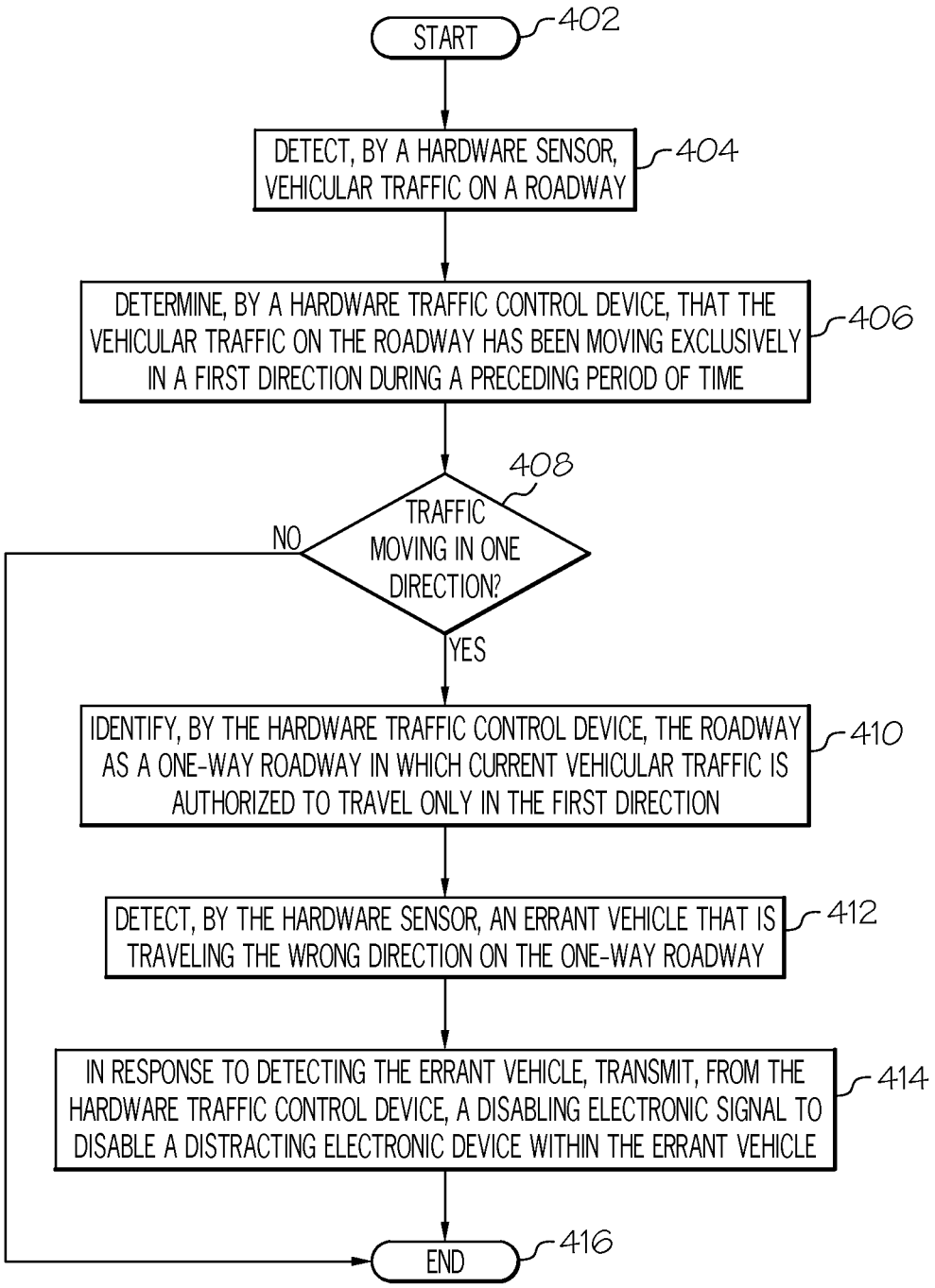
FIG. 4 is a high level flow chart of one or more exemplary steps taken by one or more processors and/or other hardware devices to control vehicular traffic on a one-way roadway.

With reference now to FIG. 4, a high level flow chart of one or more exemplary steps taken by one or more processors and/or other hardware devices to control vehicular traffic on a one-way roadway is presented. After initiator block 402, a hardware sensor detects vehicular traffic on a roadway (block 404). As described in block 406, a hardware traffic control device determines whether the vehicular traffic on the roadway has been moving exclusively in a first direction during a preceding period of time. That is, the hardware traffic control device (e.g., hardware traffic control device 208 depicted in FIG. 2), using readings from the hardware sensor (e.g., hardware sensor 210), determines whether all of the one-way traffic vehicles 204*a*-204*c* are moving in the same direction on a particular roadway (e.g., one-way roadway 202). If so (query block 408), then the hardware traffic control device is able to identify that roadway as, in fact, being a one-way roadway in which current (e.g., present) vehicular traffic is authorized to travel only in the first direction (block 410).

However, as described in block 412, the hardware sensor later detects an errant vehicle (e.g., errant vehicle 206 depicted in FIG. 2) that is traveling in a second direction on the one-way roadway, wherein the second direction is opposite the first direction. That is, the errant vehicle is traveling in the wrong direction on the one-way roadway.

As described in block 414, in response to the hardware sensor detecting the errant vehicle, the hardware traffic control device transmits a disabling electronic signal to disable a distracting electronic device (e.g., distracting device 318 depicted in FIG. 3) within the errant vehicle. As described above, the distracting electronic device has been predetermined to reduce a driver's attention to driving a motor vehicle. Alternatively, in response to the hardware sensor detecting the errant vehicle, the hardware traffic control device transmits a signal to a hardware vehicle controller within the errant vehicle, which causes the errant vehicle to be steered to a side of the one-way roadway. The process ends at terminator block 416.

In one embodiment of the present invention, the hardware traffic control device (or another device) transmits an emergency activation signal to the distracting electronic device. This emergency activation signal overrides the disabling electronic signal to permit only a warning message to be presented by the distracting electronic device. For example, assume that the distracting device is a cell phone that is in "texting" mode. The normal texting ability continues to be disabled, but the distracting device is allowed to be activated enough to present a warning message (in text or sound) warning the driver of the errant vehicle that he/she is traveling in the wrong direction on the one-way roadway.

In one embodiment of the present invention, the hardware sensor comprises a pair of electronic signal emitters, such as the first electronic signal emitter 220*a* and the second electronic signal emitter 220*b* depicted in FIG. 2. Note that the first electronic signal emitter 220*a* is spatially positioned before the second electronic signal emitter when moving in the first direction (i.e., in the correct direction) along the one-way roadway. That is, when the one-way traffic vehicle 204*b* travels in the correct direction along the one-way roadway 202 shown in FIG. 2, it will first pass over/by the first electronic signal emitter 220*a* and then over/by the second electronic signal emitter 220*b*. The first electronic signal emitter 220*a* transmits a first electronic signal and the second electronic signal emitter 220*b* transmits a different second electronic signal, thus allowing a vehicle to determine whether it is traveling in the correct direction or not. For example, assume that the first electronic signal emitter 220*a* transmits "1", and the second electronic signal emitter 220*b* transmits"2". If a vehicle passing over this pair of electronic signal emitters reads a "1" and then a "2", logic within the vehicle determines that the vehicle is traveling in the correct direction over the one-way roadway. However, if a vehicle passing over this pair of electronic signal emitters reads a "2" and then a "1", logic within the vehicle determines that the vehicle is traveling in the incorrect direction (i.e., the "wrong way") over the one-way roadway. These readings are taken by an electronic signal receiver (e.g., sensor 124 depicted in FIG. 1). Thus, reading the second electronic signal before the first electronic signal causes an electronic response to be generated (e.g., by logic found within computer 102 depicted in FIG. 1) within the errant vehicle.

Note that, in one embodiment of the present invention, the first and second electronic signal emitters embedded in the roadway are active RFID chips, which have their own power supply to broadcast a specific identification or position signal. In one embodiment, the first and second electronic signal emitters embedded in the roadway are passive RFID chips, which respond to electronic interrogation signals from an electronic signal transceiver (e.g., electronic signal transceiver 158 depicted in FIG. 1) by supplying the identification/position information contained within the passive RFID chips. Note further that RFID chips are but one embodiment of electronic signal emitters that may be used. Other exemplary electronic signal emitters include any type of device that is capable of broadcasting an identification/position signal, such as beacon devices, etc.

In one embodiment of the present invention, the hardware sensor, which is part of the hardware traffic control device that is adjacent to the roadway, is an electromagnetic carrier wave transceiver (e.g., electronic signal transceiver 158 depicted in FIG. 1). That is, in this embodiment, a carrier wave set at a fixed frequency is aimed at the vehicular traffic on the roadway. A reflected carrier wave signal bounces off the vehicular traffic, and is received back at the electromagnetic carrier wave transceiver. The electronic carrier wave transceiver and/or associated logic (e.g., execution of instructions within VTCL 148 depicted in FIG. 1) determines any Doppler shift in the carrier wave between what was broadcast from the electronic carrier wave transceiver and what was returned to the electronic carrier wave transceiver. For example, assume that the electronic carrier wave transceiver is positioned to aim its carrier wave at oncoming traffic, assuming that the oncoming traffic is traveling in the correct direction on the one-way roadway. In this example, a first Doppler shift (i.e., the frequency of the carrier wave is shorter when it is reflected back) to the reflected carrier wave signal identifies the vehicular traffic as traveling in the first direction (i.e., correct direction) on the one-way roadway. However, a second Doppler shift (i.e., the frequency of the carrier wave is longer when it is reflected back) to the reflected carrier wave signal identifies errant traffic that is traveling in the second direction (i.e., the "wrong way") on the one-way roadway.

In one embodiment of the present invention, a warning sign (e.g., warning sign 214 depicted in FIG. 2) is adjacent to the one-way roadway. As depicted in FIG. 2, a photoreceptor 216, which is aimed away from the one-way traffic vehicles 204*a*-204*c* and towards the errant vehicle 206, receives light from a headlight on the errant vehicle. The photoreceptor is in electronic communication with a warning sign that is adjacent to the one-way roadway, and the warning sign (as well as the photoreceptor) are aimed away from the vehicular traffic that is moving in the first direction on the one-way roadway (e.g., one-way traffic vehicles 204*a*-204*c*). In response to the photoreceptor receiving/detecting light from the headlight on the errant vehicle, the warning sign is illuminated. That is, headlights from the one-way traffic vehicles 204*a*-204*c* never strike the photoreceptor 216 shown in FIG. 2, and thus the warning display 218 remains darkened. However, headlights from the errant vehicle will strike the photoreceptor, thus causing the warning display 218 to be activated (e.g., a printed sign is illuminated; an electronic sign is turned on and/or caused to flash on and off; etc.).

In one embodiment of the present invention, the one-way status of a roadway is confirmed by historical records. For example, one or more processors can retrieve (from a database of operational records for the roadway) a historical record of traffic flow on the one-way roadway. If this historical record shows that all (or alternatively, more than some predetermined percentage of) vehicular traffic has traveled in a certain direction (i.e., the "correct direction" for a one-way street), then this historical record confirms that current vehicular traffic is authorized to travel only in the first direction based on the historical record of traffic flow on the one-way roadway.

In one embodiment of the present invention, in response to determining that the errant vehicle is traveling in the second direction on the one-way roadway, a hardware vehicle controller within the errant vehicle automatically steers the errant vehicle to a side of the one-way roadway. That is, if logic within the hardware traffic control device 208 depicted in FIG. 2 and/or the hardware vehicle controller 302 depicted in FIG. 3 determines that the errant vehicle is traveling in the wrong direction along the one-way roadway, then the hardware vehicle controller controls the steering mechanism 310 and/or throttle controller 312 and/or braking system 306 to safely move the errant vehicle to the side of the roadway and out of the path of oncoming traffic. In one embodiment, this steering override only occurs after a predetermine length of time has elapsed without a driver of the errant vehicle taking corrective actions to prevent the errant vehicle from traveling in the second direction on the one-way roadway. That is, a certain amount of time (e.g., five seconds) is first given to the driver to recognize that he is traveling the wrong direction on the one-way roadway. If the driver does nothing to alter the course and/or speed of the vehicle within that time, then the system automatically steers the vehicle to the side of the roadway.

In one embodiment of the present invention, in response to determining that the errant vehicle is traveling in the second direction ("wrong way") on the one-way roadway, the hardware vehicle controller within the errant vehicle automatically decreases a speed at which the errant vehicle is traveling. That is, if the hardware vehicle controller 302 depicted in FIG. 3 determines that the vehicle is traveling in the wrong direction on a one-way roadway, then the throttle controller 312 and/or braking system 306 are instructed to slow down, but not fully stop, the errant vehicle. This slower speed allows the driver to still steer the errant vehicle, rather than having the errant vehicle create a fixed road hazard to oncoming traffic.

In one embodiment of the present invention, the hardware vehicle controller within the errant vehicle receives an override signal from a driver of the errant vehicle, wherein the override signal blocks the automatic decreasing of the speed at which the errant vehicle is traveling. That is, in this embodiment, the driver activates an override signal (e.g., by a voice/touch command that is detected by the user input device 320 and sent to the on-board hardware vehicle controller 302 depicted in FIG. 3), which allows the driver to maintain speed control over the vehicle.

In one embodiment of the present invention, the hardware vehicle controller within the errant vehicle automatically generates the override signal based on a proximity of the errant vehicle to an emergency aid facility, wherein the override signal is generated in response to the errant vehicle being within a predefined distance from the emergency aid facility. For example, assume that the errant vehicle is within a couple of blocks of a hospital. The combination of the errant driving of the vehicle and the proximity to the hospital is construed as the driver having a medical emergency, in which he must take any route he deems most expedient to reach the hospital. In this embodiment, the hardware vehicle controller will override the herein-described speed restrictions and/or steering overrides, but will maintain the visual/aural warning signals (i.e., flashing lights, honking horn) that are emanating from the errant vehicle.

In one embodiment of the present invention, in response to determining that the errant vehicle 206 is traveling in the second direction (the "wrong way") on the one-way roadway, a warning signal is transmitted to other vehicles on the one-way roadway, wherein the other vehicles exclude the errant vehicle. That is, if a determination is made that the errant vehicle 206 in FIG. 2 is traveling in the wrong direction on the one-way roadway 202, then the other traffic that is traveling in the correct direction (e.g., one-way traffic vehicles 204*a*-204*c*) are appropriated to act as mobile and dynamic warning devices. This action occurs in response to the hardware traffic control device 208 (adjacent to the one-way roadway 202 and shown in FIG. 2) and/or the hardware vehicle controller 302 (within the errant vehicle and shown in FIG. 3) sending a signal to the hardware vehicle controllers 302 in the one-way traffic vehicles 204*a*-204*c*, causing the flashers/horns/lights in the one-way traffic vehicles 204*a*-204*c* to be activated, thus warning the driver of the errant vehicle 206 that he/she is traveling in the wrong direction. In one embodiment, the warning signal to the other vehicles (e.g., one-way traffic vehicles 204*a*-204*c*) causes the other vehicles to reduce a speed at which they are traveling.

In one embodiment of the present invention, in response to determining that the errant vehicle 206 is traveling in the second direction ("wrong way") on the one-way roadway, the hardware traffic control device 208 and/or the hardware vehicle controller 302 within the errant vehicle 206 and/or the hardware vehicle controllers 302 in the one-way traffic vehicles 204*a*-204*c* send signals to both the errant vehicle 206 and the one-way traffic vehicles 204*a*-204*c*, causing the flashers/horns/lights of both the errant vehicle 206 and the one-way traffic vehicles 204*a*-204*c* to be activated simultaneously. This simultaneous activation allows both the driver of the errant vehicle 206 and the drivers of the one-way traffic vehicles 204*a*-204*c* to be warned simultaneously of the danger of collision.

In one embodiment of the present invention, a computer program product controls vehicular traffic on a one-way roadway. The computer program product comprises a computer readable storage medium having program code embodied therewith, and the program code is readable and executable by one or more processors to perform a method comprising: receiving a detection, by a hardware sensor, of vehicular traffic on a roadway; determining, based on the detection of vehicular traffic from the hardware sensor, that the vehicular traffic on the roadway has been moving exclusively in a first direction during a preceding period of time; in response to determining that the vehicular traffic has been moving exclusively in the first direction during the preceding period of time, identifying the roadway as a one-way roadway in which current vehicular traffic is authorized to travel only in the first direction; receiving, from the hardware sensor, a signal identifying an errant vehicle that is traveling in a second direction on the one-way roadway, wherein the second direction is opposite the first direction; and transmitting an electronic signal to disable a distracting electronic device within the errant vehicle, wherein the distracting electronic device has been predetermined to reduce a driver's attention to driving a motor vehicle.

In one embodiment of the present invention, the program code is further readable and executable to: retrieve a historical record of traffic flow on the one-way roadway; and confirm that current vehicular traffic is authorized to travel only in the first direction based on the historical record of traffic flow on the one-way roadway.

In one embodiment of the present invention, the program code is further readable and executable to: in response to determining that the errant vehicle is traveling in the second direction on the one-way roadway, automatically steer the errant vehicle to a side of the one-way roadway.

In one embodiment of the present invention, a hardware traffic control device (e.g., hardware traffic control device 208 depicted in FIG. 2) is physically positioned adjacent to a roadway. The hardware traffic control device comprises: a hardware sensor (e.g., hardware sensor 210 depicted in FIG. 2), wherein the hardware sensor: detects vehicular traffic on a roadway; determines that the vehicular traffic on the roadway has been moving exclusively in a first direction during a preceding period of time; in response to determining that the vehicular traffic has been moving exclusively in the first direction during the preceding period of time, identifies the roadway as a one-way roadway in which current vehicular traffic is authorized to travel only in the first direction; and detects an errant vehicle that is traveling in a second direction on the one-way roadway, wherein the second direction is opposite the first direction. The hardware traffic control device also comprises a disabling signal transmitter (e.g., transceiver 212 depicted in FIG. 2), wherein the disabling signal transmitter transmits a disabling electronic signal to disable a distracting electronic device within the errant vehicle, wherein the distracting electronic device has been predetermined to reduce a driver's attention to driving a motor vehicle.

In one embodiment of the present invention, the hardware traffic control device further comprises: an emergency activation signal transmitter (also part of the transceiver 212 depicted in FIG. 2), wherein the emergency activation signal transmitter transmits an emergency activation signal to the distracting electronic device, wherein the emergency activation signal overrides the disabling electronic signal to permit only a warning message to be presented by the distracting electronic device.

In one embodiment of the present invention, a hardware traffic control device (e.g., hardware traffic control device 208 depicted in FIG. 2) further comprises an emergency steering signal transmitter (e.g., transceiver 212 depicted in FIG. 2), wherein the emergency steering signal transmitter, in response to determining that the errant vehicle is traveling in the second direction on the one-way roadway, transmits an emergency steering signal to automatically steer, by a hardware vehicle controller within the errant vehicle, the errant vehicle to a side of the one-way roadway. In one embodiment, the errant vehicle is automatically steered to the side of the one-way roadway only after a predetermined length of time has elapsed without a driver of the errant vehicle taking corrective actions to prevent the errant vehicle from traveling farther in the second direction on the one-way roadway.

In one embodiment of the present invention, the hardware traffic control device (e.g., hardware traffic control device 208 depicted in FIG. 2) comprises a traffic control processor (e.g., element 104 shown in FIG. 1), wherein the traffic control processor: retrieves a historical record of traffic flow on the one-way roadway; and confirms that current vehicular traffic is authorized to travel only in the first direction based on the historical record of traffic flow on the one-way roadway.

In one embodiment of the present invention, the hardware traffic control device further comprises a speed control signal transmitter (e.g., transceiver 212 shown in FIG. 2), wherein the speed control signal transmitter, in response to determining that the errant vehicle is traveling in the second direction on the one-way roadway, transmits a speed control signal, to a hardware vehicle controller within the errant vehicle, to automatically decrease a speed at which the errant vehicle is traveling.

In one embodiment of the present invention, the hardware traffic control device further comprises a warning signal transmitter (e.g., transceiver 212 shown in FIG. 2), wherein the warning signal transmitter transmits, in response to determining that the errant vehicle is traveling in the second direction on the one-way roadway, a warning signal to other vehicles on the one-way roadway, wherein the other vehicles exclude the errant vehicle, and wherein the warning signal to the other vehicles causes flasher lights and horns on the other vehicles to activate.

In one embodiment of the present invention, a computer program product for controls vehicular traffic on a one-way roadway. The computer program product comprises a computer readable storage medium having program code embodied therewith, the program code readable and executable by one or more processors to perform a method comprising: receiving a detection, by a hardware sensor, of vehicular traffic on a roadway; determining, based on the detection of vehicular traffic from the hardware sensor, that the vehicular traffic on the roadway has been moving exclusively in a first direction during a preceding period of time; in response to determining that the vehicular traffic has been moving exclusively in the first direction during the preceding period of time, identifying the roadway as a one-way roadway in which current vehicular traffic is authorized to travel only in the first direction; receiving, from the hardware sensor, a signal identifying an errant vehicle that is traveling in a second direction on the one-way roadway, wherein the second direction is opposite the first direction; and in response to determining that the errant vehicle is traveling in the second direction on the one-way roadway, automatically transmit a signal, to a hardware vehicle controller within the errant vehicle, to steer the errant vehicle to a side of the one-way roadway.

In one embodiment of the present invention, the program code is further readable and executable to: automatically steer, by the hardware vehicle controller within the errant vehicle, the errant vehicle to the side of the one-way roadway only after a predetermined length of time has elapsed without a driver of the errant vehicle taking corrective actions to prevent the errant vehicle from traveling farther in the second direction on the one-way roadway.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of various embodiments of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Note further that any methods described in the present disclosure may be implemented through the use of a VHDL (VHSIC Hardware Description Language) program and a VHDL chip. VHDL is an exemplary design-entry language for Field Programmable Gate Arrays (FPGAs), Application Specific Integrated Circuits (ASICs), and other similar electronic devices. Thus, any software-implemented method described herein may be emulated by a hardware-based VHDL program, which is then applied to a VHDL chip, such as a FPGA.

Having thus described embodiments of the invention of the present application in detail and by reference to illustrative embodiments thereof, it will be apparent that modifications and variations are possible without departing from the scope of the invention defined in the appended claims.

What is claimed is:

1. A method of controlling vehicular traffic on a one-way roadway, the method comprising:

detecting, by a hardware sensor, vehicular traffic on a roadway;

determining, by a hardware traffic control device, whether the vehicular traffic on the roadway has been moving exclusively in a first direction during a preceding period of time;

in response to determining that the vehicular traffic has been moving exclusively in the first direction during the preceding period of time, identifying, by the hardware traffic control device, the roadway as a one-way roadway in which current vehicular traffic is authorized to travel only in the first direction;

detecting, by the hardware sensor, an errant vehicle that is traveling in a second direction on the one-way roadway, wherein the second direction is opposite the first direction; and in response to determining that the errant vehicle is traveling in the second direction on the one-way roadway, transmitting a warning signal to other vehicles on the one-way roadway, wherein the other vehicles exclude the errant vehicle.

2. The method of claim 1, wherein the warning signal to the other vehicles causes flasher lights and horns on the other vehicles to activate.

3. The method of claim 1, wherein the warning signal to the other vehicles causes the other vehicles to reduce a speed at which the other vehicles are traveling.

4. The method of claim 1, wherein the hardware sensor comprises a pair of electronic signal emitters, wherein the pair of electronic signal emitters comprises a first electronic signal emitter and a second electronic signal emitter, wherein the first electronic signal emitter is spatially positioned before the second electronic signal emitter when moving in the first direction, and wherein the method further comprises:

transmitting a first electronic signal from the first electronic signal emitter;

transmitting a second electronic signal from the second electronic signal emitter, wherein broadcast ranges of the first electronic signal and the second electronic signal are less than a distance between the first electronic signal emitter and the second electronic signal emitter, and wherein receipt, by an electronic signal receiver in the errant vehicle, of the second electronic signal before the first electronic signal causes an electronic response within the errant vehicle.

5. The method of claim 4, wherein the pair of electronic signal emitters are radio frequency identification (RFID) chips.

6. The method of claim 1, wherein the hardware sensor is an electromagnetic carrier wave transceiver, and wherein the hardware sensor further comprises:

aiming the electromagnetic carrier wave transceiver at the vehicular traffic on the roadway;

receiving a reflected carrier wave signal at the electromagnetic carrier wave transceiver;

utilizing a first Doppler shift for the reflected carrier wave signal to identify the vehicular traffic that is traveling in the first direction on the one-way roadway; and utilizing a second Doppler shift for the reflected carrier wave signal to identify the errant vehicle that is traveling in the second direction on the one-way roadway.

7. The method of claim 1, further comprising:

receiving, by a photoreceptor, light from a headlight on the errant vehicle, wherein the photoreceptor is in electronic communication with a warning sign that is adjacent to the one-way roadway, and wherein the photoreceptor and the warning sign are aimed away from the vehicular traffic that is moving in the first direction on the one-way roadway; and in response to receiving, by the photoreceptor, light from the headlight on the errant vehicle, illuminating the warning sign.

8. The method of claim 1, further comprising:

retrieving, by one or more processors, a historical record of traffic flow on the one-way roadway; and confirming, by one or more processors, that current vehicular traffic is authorized to travel only in the first direction based on the historical record of traffic flow on the one-way roadway.

9. The method of claim 1, further comprising:

in response to detecting the errant vehicle, transmitting, from the hardware traffic control device, a disabling electronic signal to disable a distracting electronic device within the errant vehicle, wherein the distracting electronic device has been predetermined to reduce a driver's attention to driving a motor vehicle.

10. The method of claim 9, further comprising:

transmitting an emergency activation signal to the distracting electronic device, wherein the emergency activation signal overrides the disabling electronic signal to permit only a warning message to be presented by the distracting electronic device.

11. The method of claim 1, further comprising:

in response to determining that the errant vehicle is traveling in the second direction on the one-way roadway, transmitting, to a hardware vehicle controller within the errant vehicle, a signal to automatically decrease a speed at which the errant vehicle is traveling.

12. The method of claim 11, further comprising:

receiving, from the hardware vehicle controller within the errant vehicle, an override signal from a driver of the errant vehicle, wherein the override signal blocks said automatic decreasing of the speed at which the errant vehicle is traveling.

13. The method of claim 12, further comprising:

receiving, from the hardware vehicle controller within the errant vehicle, the override signal based on a proximity of the errant vehicle to an emergency aid facility, wherein the override signal is generated in response to the errant vehicle being within a predefined distance from the emergency aid facility.

14. The method of claim 11, further comprising:

in response to determining that the errant vehicle is traveling in the second direction on the one-way roadway, transmitting a steering signal to automatically steer, by a hardware vehicle controller within the errant vehicle, the errant vehicle to a side of the one-way roadway.

15. The method of claim 14, wherein the hardware vehicle controller within the errant vehicle automatically steers the errant vehicle to the side of the one-way roadway only after a predetermined length of time has elapsed without a driver of the errant vehicle taking corrective actions to prevent the errant vehicle from traveling farther in the second direction on the one-way roadway.

* * * * *